US005258593A

United States Patent [19]

Hayakawa

[11] Patent Number: 5,258,593

[45] Date of Patent: Nov. 2, 1993

[54] ILLUMINATED SEE-SAW SWITCH DEVICE

[75] Inventor: Hiroshi Hayakawa, Furukawa, Japan

[73] Assignee: Alps Electric Co., Ltd., Tokyo, Japan

[21] Appl. No.: 864,119

[22] Filed: Apr. 6, 1992

[30] Foreign Application Priority Data

Apr. 17, 1991 [JP] Japan ..... 3-34211[U]
Apr. 19, 1991 [JP] Japan ..... 3-35132[U]
Dec. 26, 1991 [JP] Japan ..... 3-107459[U]

[51] Int. Cl.[5] ..... H01H 21/80

[52] U.S. Cl. ..... 200/315; 200/553; 200/1 B

[58] Field of Search ..... 200/315, 1 B, 18, 553

[56] References Cited

U.S. PATENT DOCUMENTS 4,710,602 12/1987 Baity et al. ..... 200/315
4,904,833 2/1990 Sato et al. ..... 200/553
5,115,108 5/1992 Ogawa et al. ..... 200/1 B
5,149,924 9/1992 Priesemuth ..... 200/315 X

FOREIGN PATENT DOCUMENTS 2203232 6/1973 Fed. Rep. of Germany ..... 200/315

*Primary Examiner*—Renee S. Luebke
*Attorney, Agent, or Firm*—Guy W. Shoup; Patrick T. Bever

[57] ABSTRACT

A switch device is provided in which a clicking touch can easily be set and which is able to stably perform a switching operation while maintaining a predetermined clicking touch, exhibiting a long life when operated and causing an advantage to be obtained in reducing a manufacturing cost. The switch device has an operating rod which is inward pushed by an end portion of an operation lever and a leaf spring which is operated by an operating rod when the operation lever is inclined by a predetermined degree, so that a desired clicking touch can be easily set by selecting the leaf spring and a problem of wear which is inevitable for realizing the clicking touch can be overcome.

2 Claims, 15 Drawing Sheets

ILLUMINATED SEE-SAW SWITCH DEVICE

BACKGROUND OF THE INVENTION

1. Filed of the Invention

The present invention relates to a switch device, and more particularly to a switch device which performs a switching operation when its operational lever is operated in a rocking manner.

2. Related Art Statement

Switch devices of a type, which is switched on/off when its operation lever is operated in a rocking manner, have been used as, for example, switches for opening/closing power windows of automobiles. FIG. 15 is an exploded perspective view which illustrates the structure of a switch device of the aforesaid conventional type. An operation lever 2 formed into a substantially rectangular-shape is provided in such a way that it can be rotated around a support shaft 1. The operation lever 2 has three fastening holes 2*a* in the bottom surface thereof, the fastening holes 2*a* respectively accommodating corresponding drive rods 6 to 8 while interposing springs 10 so as to be elastically pressed. A lower case 12 of the switch device has a projection 13 secured to the top surface thereof, the projection 13 having, on the top surface thereof, a substantially V-shaped slide surface 14 while making its central portion to be the lowermost portion. The slide surface 14 has, on the two end portions thereof, steep clicking surfaces 14*a* and 14*b*. That is, the slide surface 14 is formed by two kinds of steps composed of a first step adjacent to the central portion of the slide surface 14 and second steps formed at the two end portions of the same.

Furthermore, the projection 13 has movable contacts 15 and 16 on the two sides thereof while being respectively supported by support plates 3. The lower case 12 has fixed contacts 17*a* and 17*b* on the surface thereof in such a way that they confront the two end portions of the movable contact 15. The lower case 12 further comprises fixed contacts 18*a* and 18*b* on the surface thereof in such a way that they confront the two end portions of the movable contact 16.

In the aforesaid conventional switch device, the movable contact 15 pressed by the drive rod 6 is positioned in contact with the fixed contact 17*b* and the movable contact 16 pressed by the drive rod 7 is positioned in contact with the fixed contact 18*a* in a state where the operation lever 2 is at the neutral position. When the operation lever 2 is rotated clockwise in a direction designated by an arrow $\theta$ shown in FIG. 15 in the aforementioned state, the drive rod 8 slides on the slide surface 14 toward the clicking surface 14*a* until it reaches the clicking surface 14*a* at which the sliding resistance will be changed. As a result, the clicking touch can be confirmed. Immediately after this, the movable contact 15 is pressed by the drive rod 6 and is thereby rotated until it comes in contact with the fixed contact 17*a*. Therefore, the switching operation is performed. Although the rotation of the operation lever 2 also moves the drive rod 7 toward the fixed contact 18*a* on the surface of the movable contact 16, the movable contact 16 is not rotated due to this movement.

On the other hand, when the operation lever 2 is rotated counterclockwise in the neutral state, the drive rod 8 slides on the slide surface 14 toward the clicking surface 14*b* until it reaches the clicking surface 14*b* at which the clicking touch can be confirmed. Immediately after this, the movable contact 16 is pressed by the drive rod 7 and is thereby rotated until it comes in contact with the fixed contact 18*b*. Therefore, the switching operation is performed. Although the rotation of the operation lever 2 also moves the drive rod 6 toward the fixed contact 17*b* on the surface of the movable contact 15, the movable contact 15 is not rotated due to this movement. The aforesaid switch device can be used as, for example, a switch for a power window for an automobile. In this case, a manual operation for opening the window to an arbitrary degree is performed at the first step and an operation of fully opening or fully closing is performed at the second step.

The conventional switch device enables the predetermined clicking touch to be realized by the shape of the slide surface 14 of the projection. Therefore, the degrees of the clicking touch cannot easily be varied. Furthermore, since the three fastening holes 2*a* must be formed in the operation lever 2 and the fastening holes 2*a* must accommodate the springs 10 and the drive rods 6 to 8, an optical path cannot be formed in the operation lever 2. Therefore, an illumination type switch cannot be realized. Furthermore, the slide surface 14 wears down whenever it is used, causing a problem of durability to arise.

SUMMARY OF THE INVENTION

In order to overcome the problems experienced with the conventional switch devices, an object of the present invention is to provide a switch device in which a clicking touch can easily be set, which exhibits a long operational life and which enables an advantage to be obtained in that the manufacturing cost can be reduced.

In order to achieve the aforementioned object, according to one aspect of the present invention, there is provided a switch device having an operation lever which is inclined around a support shaft so as to rock a movable contact so that a switching operation is performed between a fixed contact and a movable contact, the switch device comprising an operating rod which is inwards moved by the end portion of the operation lever which is inclined around the support shaft, a leaf spring which is reversed by a movement of the operating rod when the inclination reaches a predetermined angle, and a switch portion which is switched on/off by the operating rod.

According to another aspect of the present invention, there is provided a switch device in which illuminating light is introduced into an operation lever thereof, a surface of the operation lever to be illuminated with light is illuminated with the illuminating light and in which a switching operation is performed between a fixed contact and a movable contact when the operation lever is rocked around a rotation shaft, the switch device comprising light conductive material which forms the operation lever and a light reflecting surface for introducing the illuminating light made incident upon the side surface of the operation lever to the surface to be illuminated with light, the light reflecting surface being formed on the bottom surface of the operation lever.

When the operation lever is rotated around the rotational shaft by the aforesaid means, the operating rod is pushed inwards by the end portion of the operation lever which is being inclined. When the inclination of the operation lever reaches a predetermined angle, the leaf spring is pushed inwards by the operating rod and is reversed while realizing a clicking touch. The switch portion is pushed by the operating rod so as to perform the switching operation. Therefore, the clicking touch is realized by the reverse operation of the leaf spring when it is pushed inwards. As a result, the sliding portion for realizing the clicking touch can be eliminated from the structure. Illuminating light made incident upon the surface of the operation lever is reflected by the light reflecting surface formed on the bottom surface of the operation lever, and is transmitted to the surface to be illuminated with the light through the operation lever made of light conductive material. As a result, the surface of the operation lever is illuminated with the aforesaid illuminating light. When the operation lever having the surface to be illuminated with light is being illuminated is rocked around the rotation shaft, a switching operation is performed between the fixed contact and the movable contact.

Other and further objects, features and advantages of the invention will appear more fully from the following description.

BRIEF DESCRIPTION OF THE DRAWINGS

FIG. 4 illustrates a position at which a manual switch according to the first embodiment of the present invention is switched on;

FIG. 5 illustrates a position at which an automatic switch according to the first embodiment of the present invention is maintained at a state where it is switched on;

FIG. 13 illustrates a position at which a manual switch according to the second embodiment of the present invention is switched on;

FIG. 14 illustrates a position at which an automatic switch according to the second embodiment of the present invention is switched on.

DESCRIPTION OF THE PREFERRED EMBODIMENTS

An embodiment of the present invention in which the present invention is applied to a switch for a power window will now be described with reference to FIGS. 1 to 6.

Figure 1:
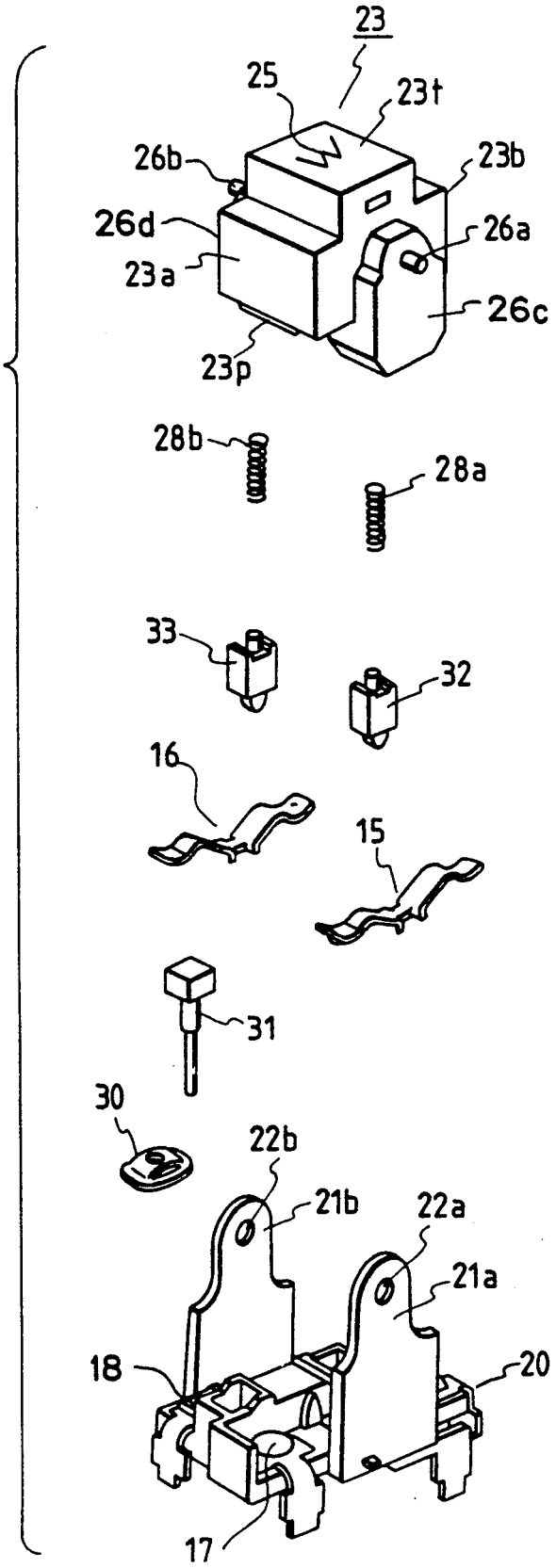
FIG. 1 is an exploded perspective view which illustrates the structure of a first embodiment of the present invention.
Figure 2A:
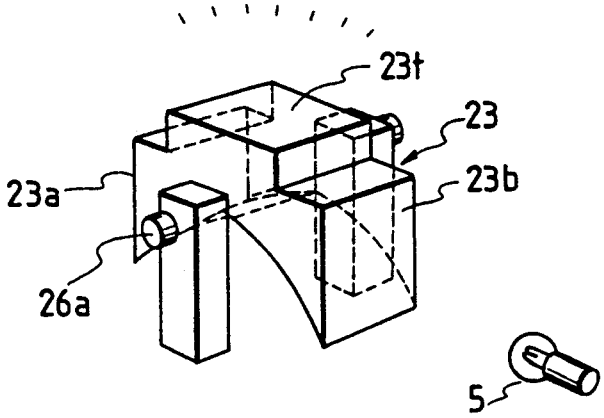
FIGS. 2(*a*) and 2(*b*) are perspective and side views, respectively, illustrating a state of illumination performed according to the first embodiment of the present invention.
Figure 2B:
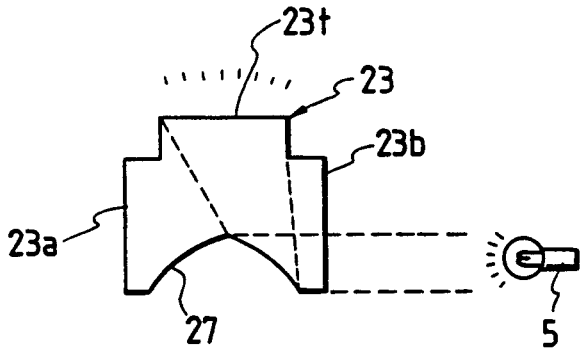
Figure 3:
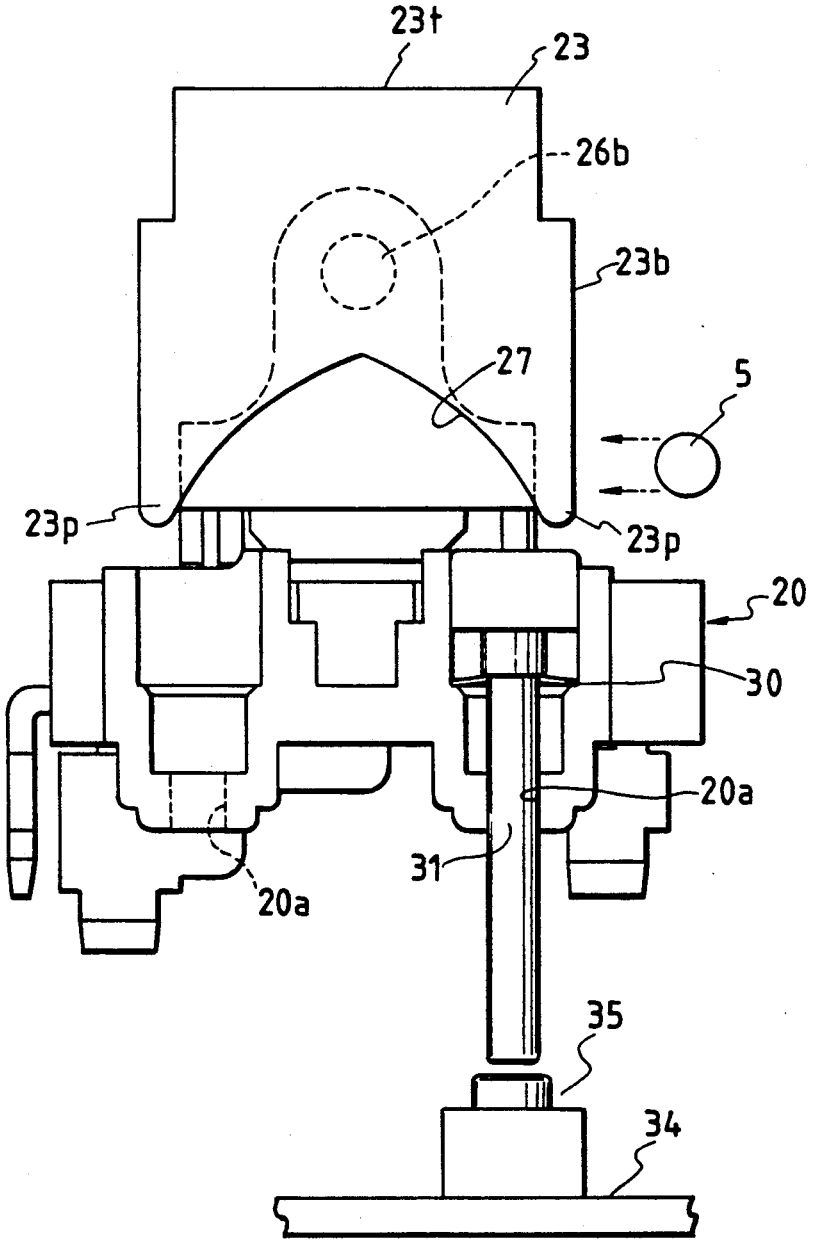
FIG. 3 illustrates a neutral position according to the first embodiment of the present invention.
Figure 4:
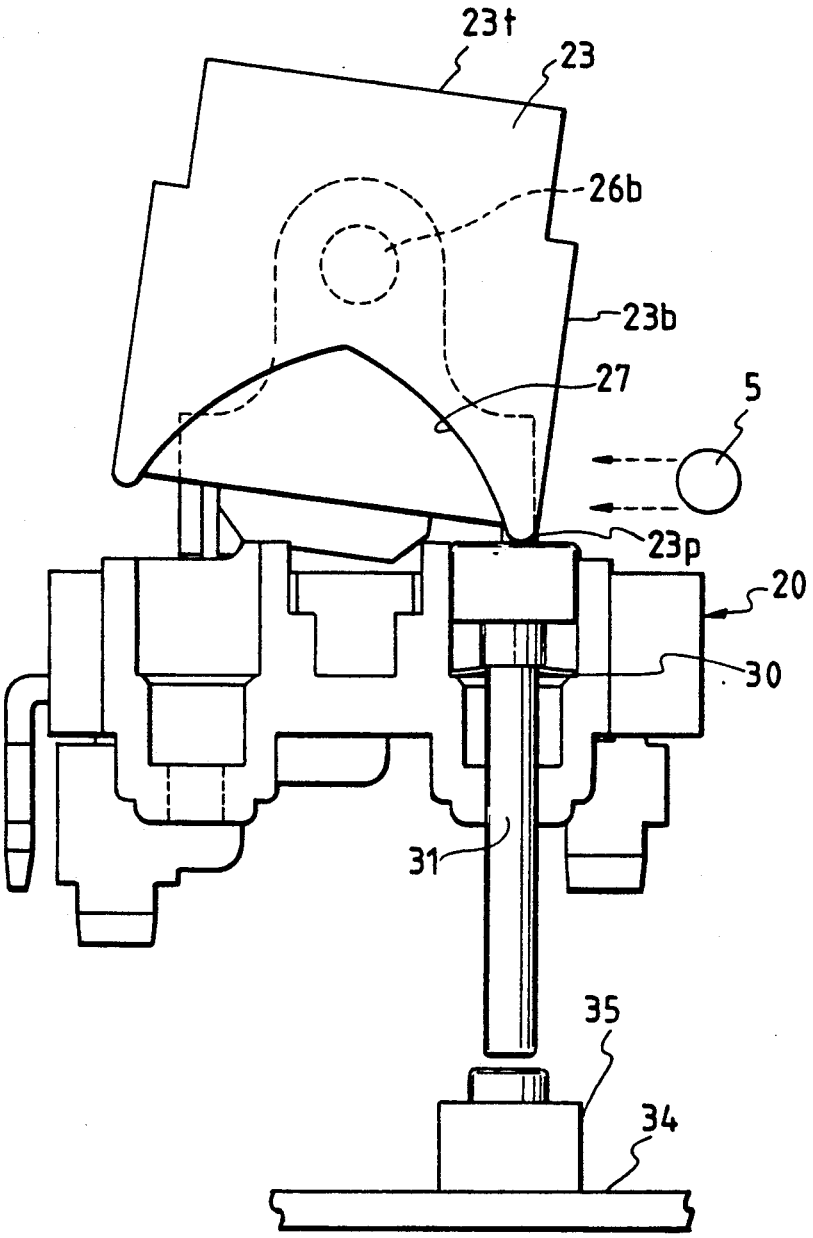
Figure 5:
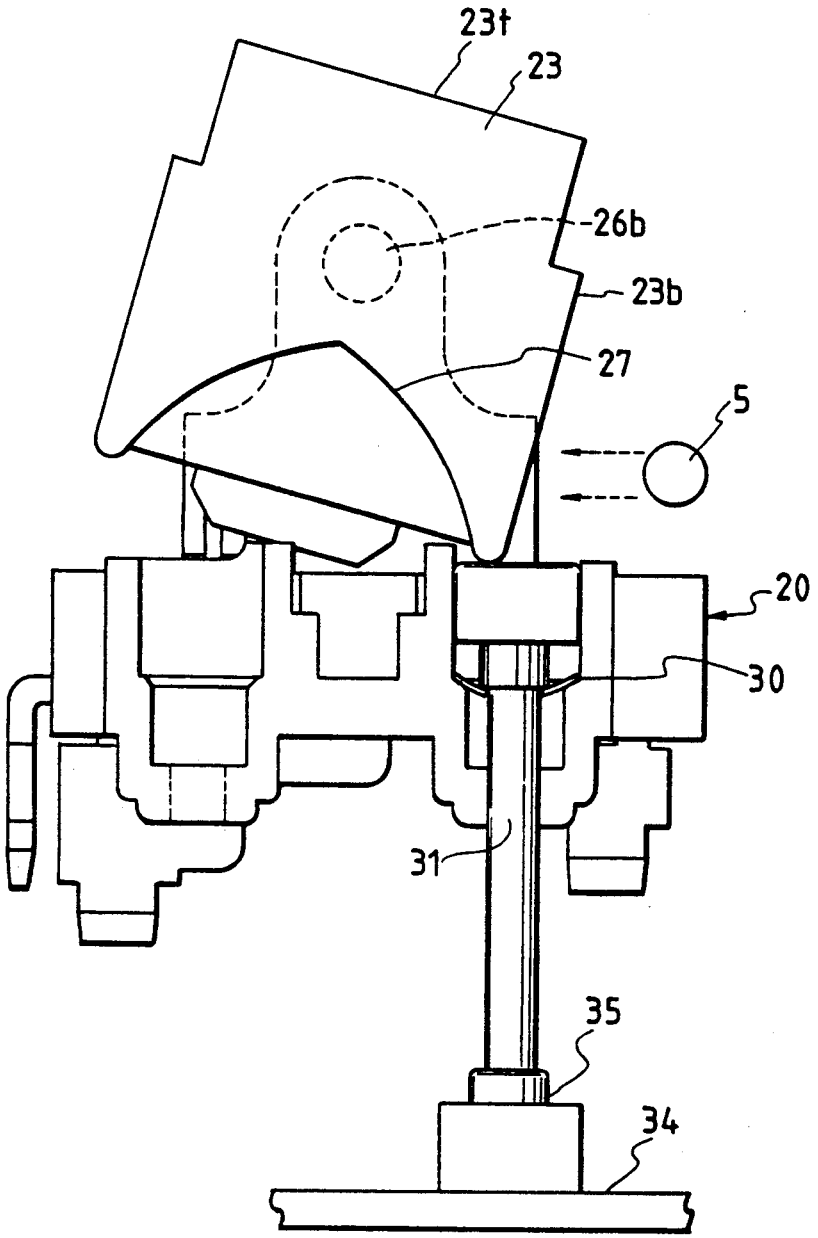
Figure 6:
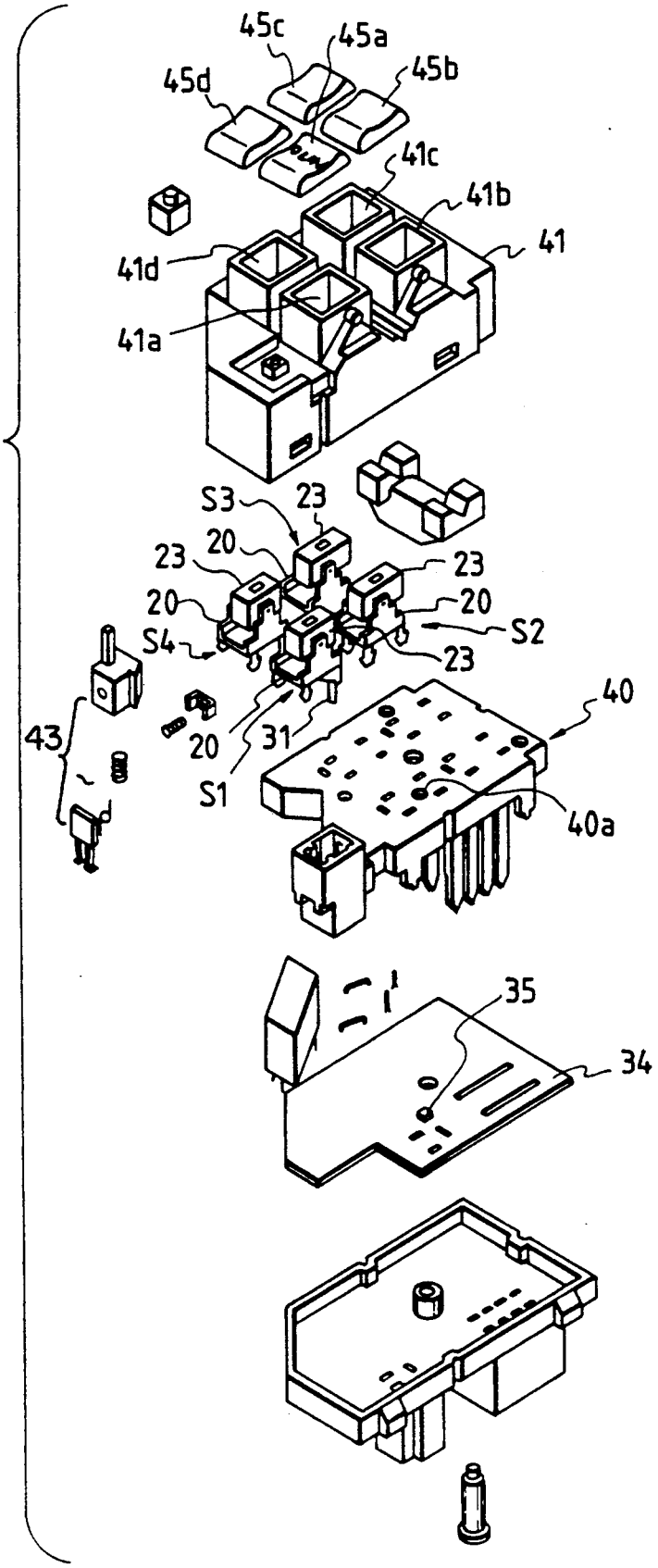
FIG. 6 is an exploded perspective view which illustrates the overall body of a switch for a power window to which the first embodiment of the present invention is applied.

FIGS. 1 to 6 illustrate a first embodiment of the present invention. FIG. 1 is an exploded perspective view which illustrates the first embodiment, FIGS. 2(*a*) and 2(*b*) illustrate a state of illumination performed according to the first embodiment, FIGS. 3 to 5 illustrate an operation of the operation lever in a rocking manner to be performed according to the first embodiment and FIG. 6 is an exploded perspective view which illustrates the overall body of a power window switch according to the first embodiment.

As shown in FIG. 1, a wafer 20 has, on the side surface thereof, holding arms 21*a* and 21*b* which confront each other and which respectively have shaft holes 22*a* and 22*b*. On the other hand, an operation lever 23 made of light conductive material such as an acrylic resin has support shafts 26*a* and 26*b* on the side portion thereof in such a manner that the support shafts 26*a* and 26*b* project beyond the surface of the operation lever 23. Furthermore, the operation lever 23 has holding portions 26*c* and 26*d*. The support shafts 26*a* and 26*b* of the operation lever 23 are inserted into the aforesaid shaft holes 22*a* and 22*b*. As a result, the operation lever 23 can be rotatively fastened.

As shown in FIGS. 2(*a*) and 2(*b*), the operation lever 23 has a curved concave surface 27 on the bottom surface thereof. Furthermore, a light source lamp 5 is disposed adjacent to a side surface 23*b* of the operation lever 23 in such a manner that the lamp 5 confronts the side surface 23*b*. Therefore, a light emitted from the light source lamp 5 is upwards reflected by the curved surface 27 Light thus reflected reaches a surface 23*t* of the operation lever 23, the surface 23*t* being the surface to be illuminated with light. An operation display 25 printed on the surface 23*t* is illuminated with light from the reverse side. In the first embodiment, the shape of the curved surface 27 and an angle made by light emitted from the illumination lamp 5 are determined so as to maintain the quantity of light to be transmitted to the surface 23*t* at substantially a constant quantity in a range of an angle in which the operation lever 23 is operated to be described later.

Figure 15:
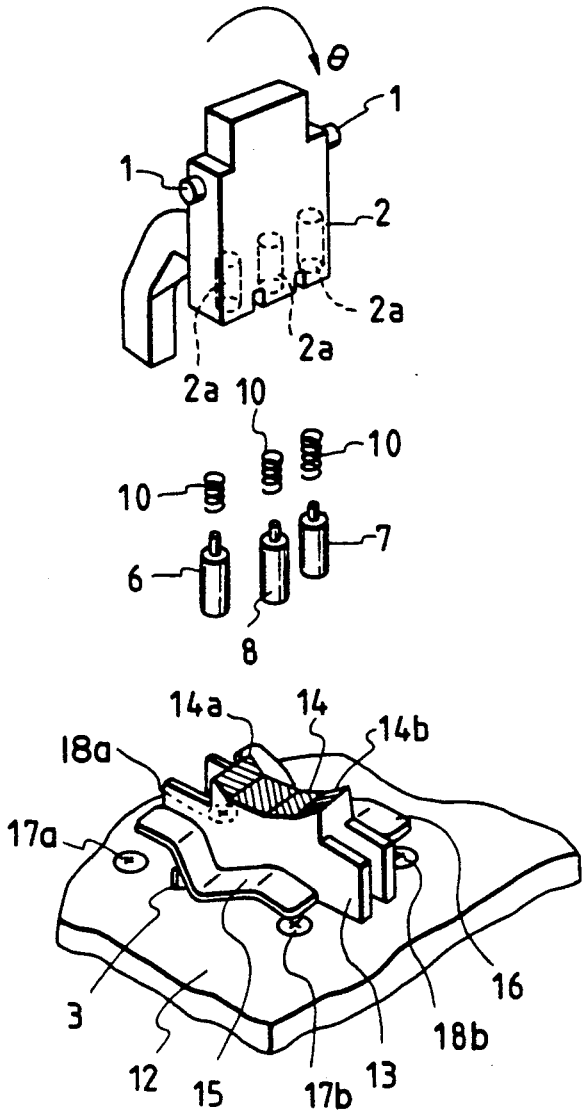
FIG. 15 PRIOR ART
FIG. 15 illustrates the structure of a conventional switch device.

The wafer 20 has fixed contacts 17 and 18 secured to the top surface thereof. In addition, the operation lever 23 has fastening holes (omitted from illustration) which respectively elastically hold drive rods 32 and 33 while interposing springs 28*a* and 28*b*. The relationships between the operation lever 23, the drive rods 32 and 33, the springs 28*a* and 28*b*, the movable contacts 15 and 16 and the fixed contact 17 are made similarly to those according to the aforesaid conventional switch device. When the operation lever 23 is rotated clockwise or counterclockwise, a pair composed of the movable contact 15 and the fixed contact 17 and another pair composed of the movable contact 16 and the fixed contact 18 perform the switching operations similarly to that to be performed in the conventional structure as shown in FIG. 15.

According to the first embodiment, the switch device has an automatic switching function for use in a power window for an automobile as well as the aforesaid manual switching function. A leaf spring 30 is mounted in a recess formed in the wafer 20. An operation rod 31, which is a control rod, is inserted into the leaf spring 30. The front end portion of the operation rod 31 is positioned adjacent to the top surface of an automatic switch 35 fastened to a printed circuit board 34. As a result, when the operation lever 23 is inclined by a predetermined angle, the operation rod 31 is pushed inwards by a pressing edge portion 23*p* of the lower surface of the operation lever 23. In this case, the movable contact 15 and the fixed contact 17 come in contact with each other at a point at which the operation lever 23 is clockwise inclined by, for example, 8° from the vertical axis. As a result, the switching operation is performed and thereby the operation of a device for opening/closing the window is commenced. When force for operating the operation lever 23 is removed, the operation lever 23 returns to its original position. As a result, the state is returned to a state in which the switch is switched off. That is, a manual operation for moving the window only in the time in which the operation lever 23 is inclined is performed. When the operation lever 23 is inclined from the vertical axis by, for example, 15°, the operation rod 31 is moved downwards by the pressing portion 23*p* of the operation lever 23. When the leaf spring 30 is pushed inwards by the front portion of the operation rod 31, the leaf spring 30 moves reversely. As a result, the clicking touch is generated by the reversed leaf spring 30 if the force for operating the operation lever 23 is removed. Therefore, the automatic switch 35 is switched on and the device for opening the window continues its operation until the window is opened fully. As a result, the automatic operation is performed.

Then, the operation of the thus constituted first embodiment will now be described with reference to FIGS. 3 to 5.

FIG. 3 illustrates a neutral state of the switch device, wherein the movable contact 15 and the fixed contact 17 are not positioned in contact with each other. Similarly, the movable contact 16 and the fixed contact 18 are not positioned in contact with each other. Therefore, a state in which the switch is switched off is realized. In this state, illumination light emitted from the light source lamp 5 is reflected by the curved surface 27 of the operation lever 23. Then, it reaches the surface 23*t* to be illuminated with light and the operation display 25 fastened to the surface 23*t* is illuminated with light so as to display it. Therefore, a driver is able to correctly detect the position of the operation lever 23 even if the driver drives the automobile at night. Therefore, the driver is able to quickly operate the operation lever 23.

When the operation lever 23 is rotated clockwise in a state shown in FIG. 3, the movable contact 15, which is being rocked, comes in contact with the fixed contact 17 at a position at which the operation lever 23 is inclined from the vertical axis by an angle of 8° as shown in FIG. 4. As a result, the switch is switched on, so that the operation of opening the window is commenced. In this case, the operation of opening the window is continued and thereby the window is gradually opened so far as the driver manually holds the operation lever 23 to maintain its position. Therefore, if the driver releases the operation lever 23 at a state in which the window is opened by a desired degree, the state shown in FIG. 3 is again realized and the switch is switched off. As a result, the operation of opening the window is stopped.

When the operation lever 23 is further rotated clockwise so as to be inclined by 15° from the vertical axis, the contact operation while realizing a first clicking touch between the movable contact 15 and the fixed contact 17 is performed and then the operation rod 31 is further moved downwards. As a result, the leaf spring 30 is reversely moved while realizing a second clicking touch, causing the automatic switch 35 to be switched on. Therefore, even if the hand is removed from the operation lever 23, the window is opened until it is opened fully and is stopped in this state. Similarly, the window can be fully closed by the counterclockwise rotation of the operation lever 23.

FIG. 6 is an exploded perspective view which illustrates the overall body of the power window switch according to the first embodiment of the present invention. A lower case 40 has a printed circuit board 42 and various electronic elements 43 fastened thereto. The lower case 40 has the aforesaid switch device represented by S1 here and a switch devices S2 to S4 each having no automatic switch portion disposed thereof. An upper case 41 having four-walled accommodating chambers 41*a* to 41*d* formed thereon is fastened to the lower case 40 in such a manner that the switch devices S1 to S4 are respectively positioned in the aforesaid accommodating chambers 41*a* to 41*d*. Buttons 45*a* to 45*d* are fastened while confronting the opened areas of the accommodating chambers 41*a* to 41*d* at a position at which the buttons 45*a* to 45*d* aligns the positions of the switch levers 23 of the switch devices S1 to S4. The lower case 40 has a through hole 40*a* formed therein. As a result, the operation rod 31 penetrating the aforesaid leaf spring 30 is inserted into the through hole 40*a* so as to press the push button switch 35 secured to the printed circuit board 34. The switch devices S1 to S4 enables the four windows of an automobile to be opened/closed.

According to the first embodiment, the optimum clicking touch can easily be set by selecting the leaf spring 30. Furthermore, since the clicking touch is not obtained from the sliding action, the necessity of employing a countermeasure against wear can be eliminated. Therefore, the switching operation can be stably performed for a considerably long time while maintaining a predetermined clicking touch. Furthermore, since the switching mechanism portion is disposed while being deviated from the central portion of the operation lever 23, an illuminated type lever can be realized.

Figure 7:
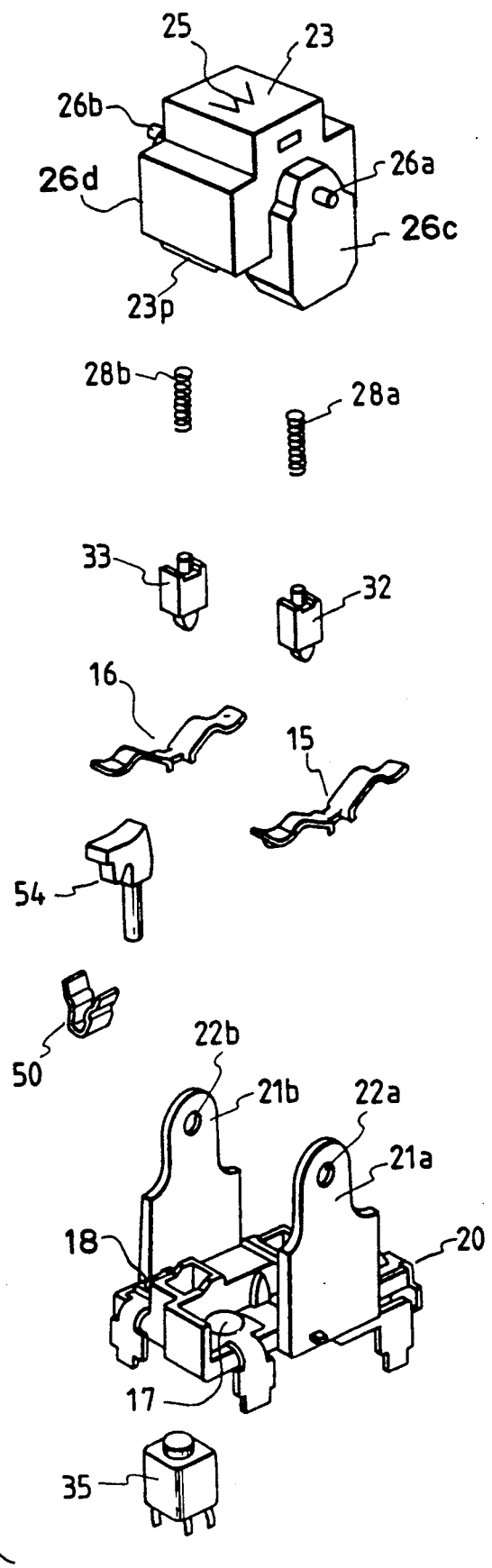
FIG. 7 is an exploded perspective view which illustrates a second embodiment of the present invention.
Figure 8:
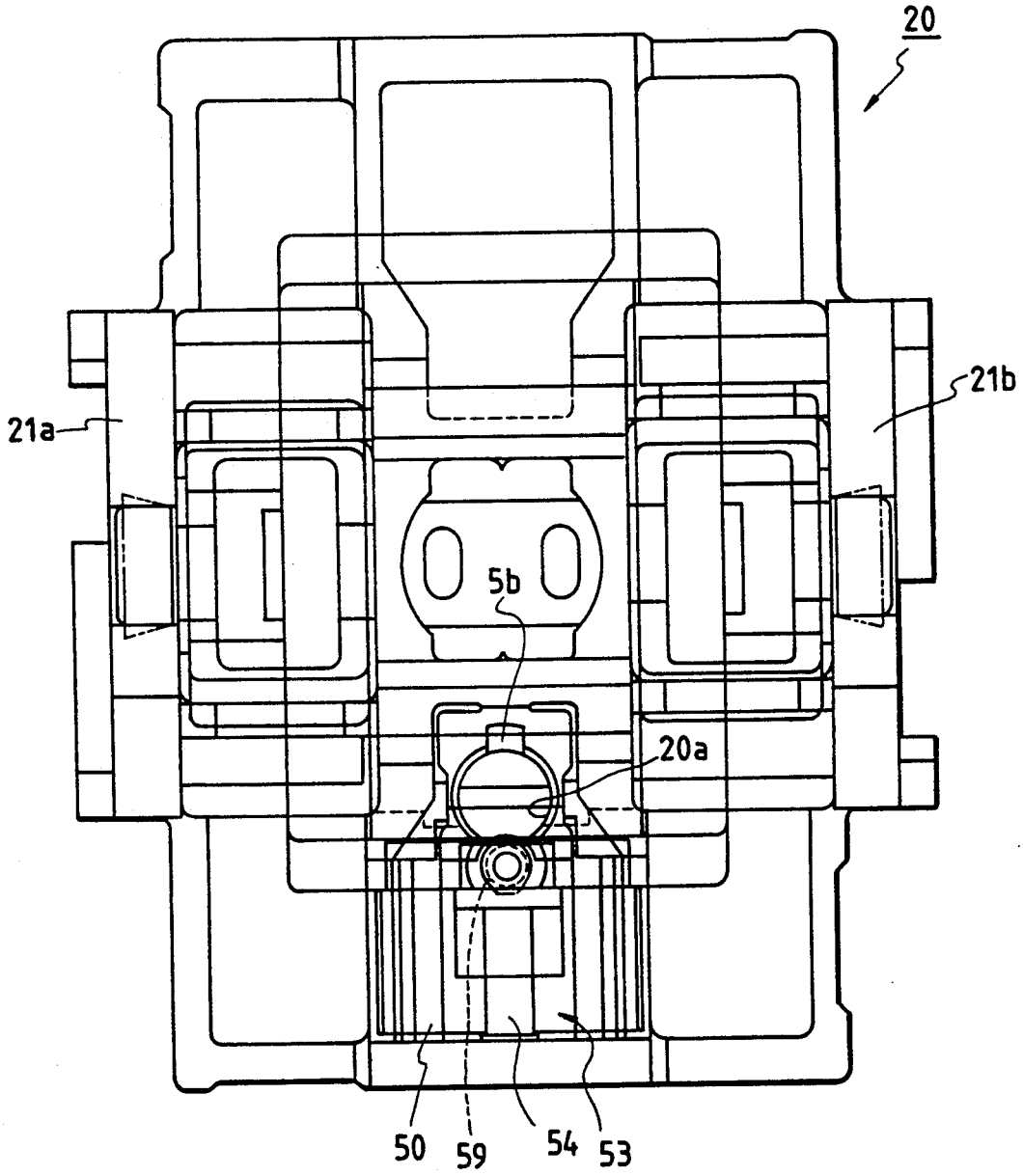
FIG. 8 is a top view which illustrates the second embodiment of the present invention.
Figure 9:
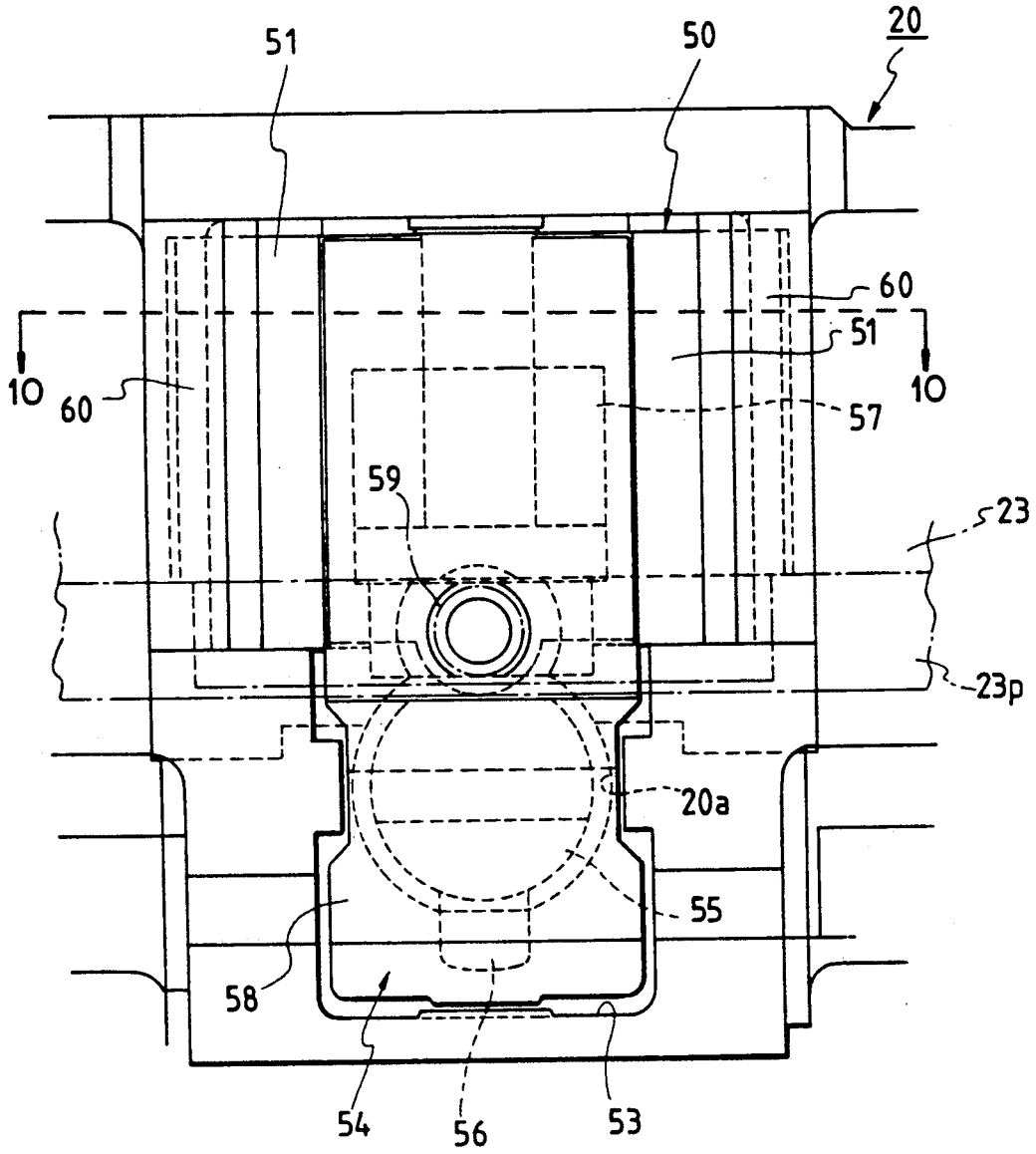
FIG. 9 is an enlarged view which illustrates an essential portion of FIG. 8.
Figure 10:
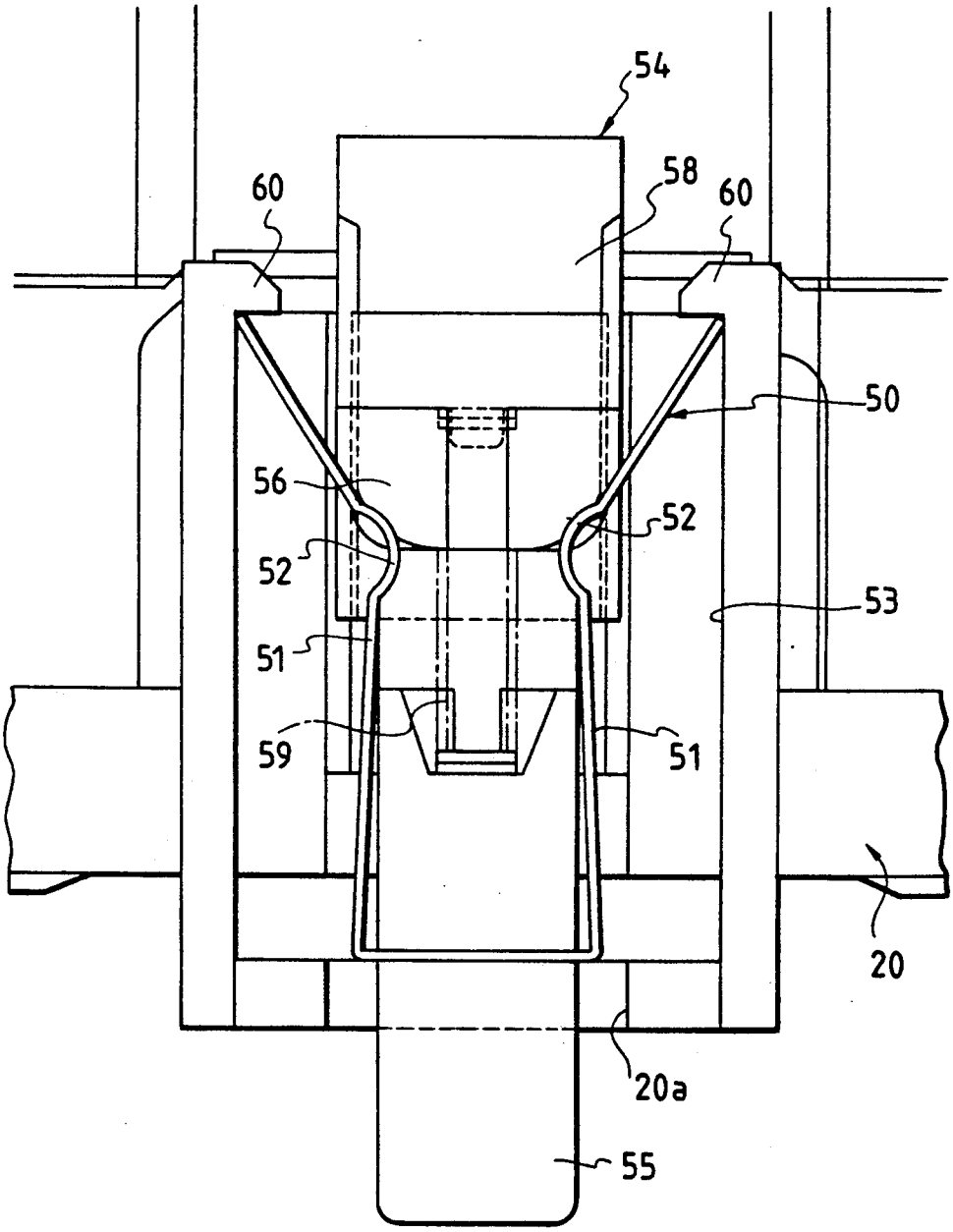
FIG. 10 is a cross sectional view taken along line 10—10 of FIG. 9.
Figure 11:
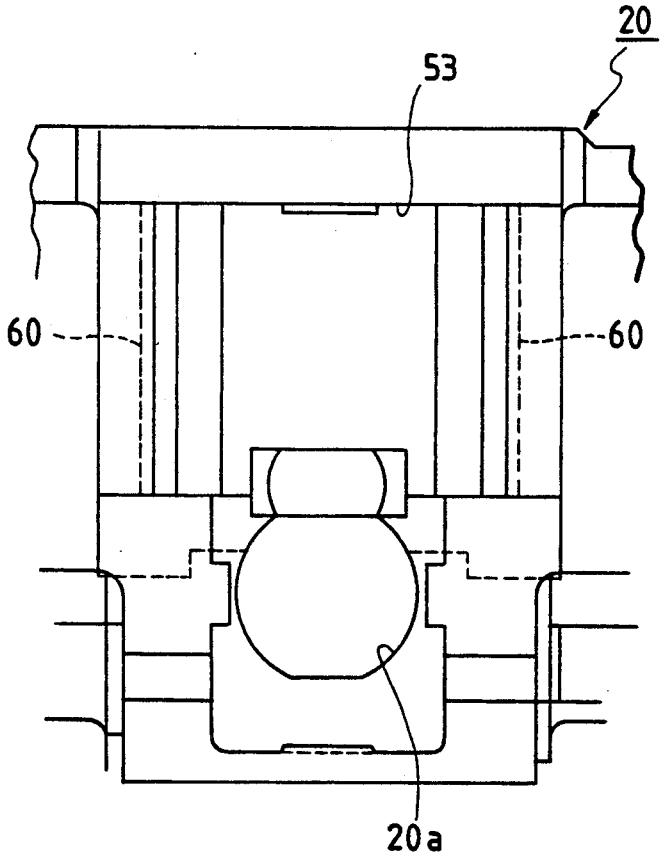
FIG. 11 is a top view which illustrates only a case similarly to FIG. 8.

FIGS. 7 to 14 illustrate a second embodiment of the present invention. FIG. 7 is an exploded perspective view which illustrates the second embodiment, FIG. 8 illustrates a top view which illustrates the second embodiment, FIG. 9 is an enlarged view which illustrates an essential portion of FIG. 8, FIG. 10 is a cross sectional view taken along line 10—10 of FIG. 9, FIG. 11 is a top view which illustrates only a case similarly to FIG. 8, and FIGS. 12 to 14 illustrate the rocking operation of an operation lever according to the second embodiment. The same or equivalent elements as those according to the first embodiment are given the same reference numerals and their descriptions are omitted here.

The featured portion of the second embodiment of the present invention will now be described. A clip-like leaf spring 50 is used in place of the leaf spring 30 according to the first embodiment. The leaf spring 50 is formed by bending an elastic member so as to form substantially a U-shape. As a result, a pair of bent members 51 are formed which have clicking projections 52 at the substantially the central portion between them, the clicking projections 52 being formed by inwards expanding the bent members 51. The leaf spring 50 is accommodated in an accommodating hole 53 in such a manner that the free end portions of the bent members 51 are positioned upwards. Furthermore, an operating rod 54 is accommodated in the accommodating hole 53 in such a manner that the operating rod 54 is positioned adjacent to the leaf spring 50. The lower end portion of the operating rod 54 does not penetrate the leaf spring 50 but is allowed to project over a through hole 20*a* bored in the bottom portion of the accommodating hole 53. The lower end portion of the operating rod 54 is positioned adjacent to the automatic switch 35 fastened to the printed circuit board 34 similarly to the first embodiment. Therefore, when the operation lever 23 is inclined by a predetermined angle, the operating rod 54 is pushed inwards by the pressing end portion 23*p* of the lower surface of the operation lever 23. The operating rod 54 comprises a shaft portion 55 to be inserted into the through hole 20*a*, a stopper projection 56 formed to project on the side surface of the shaft portion 55, an operating portion 57 to be held between the bent members 51 of the leaf spring 50 and slides on the inner surfaces of the bent members 51 and the clicking projections 52 when the operating rod 54 is pushed inwards and a slide surface 58 formed on the top surface and composed of a flat surface and an inclined surface. Reference numeral 59 represents a coil spring interposed between the bottom surface of the operating portion 57 and the bottom surface of the accommodating hole 53 and acting to urge the operating rod 54 in a direction opposing the inward-pushing direction. Although omitted from the particular description here, the structure and the operation according to this embodiment are the same as those according to the first embodiment.

Figure 14:
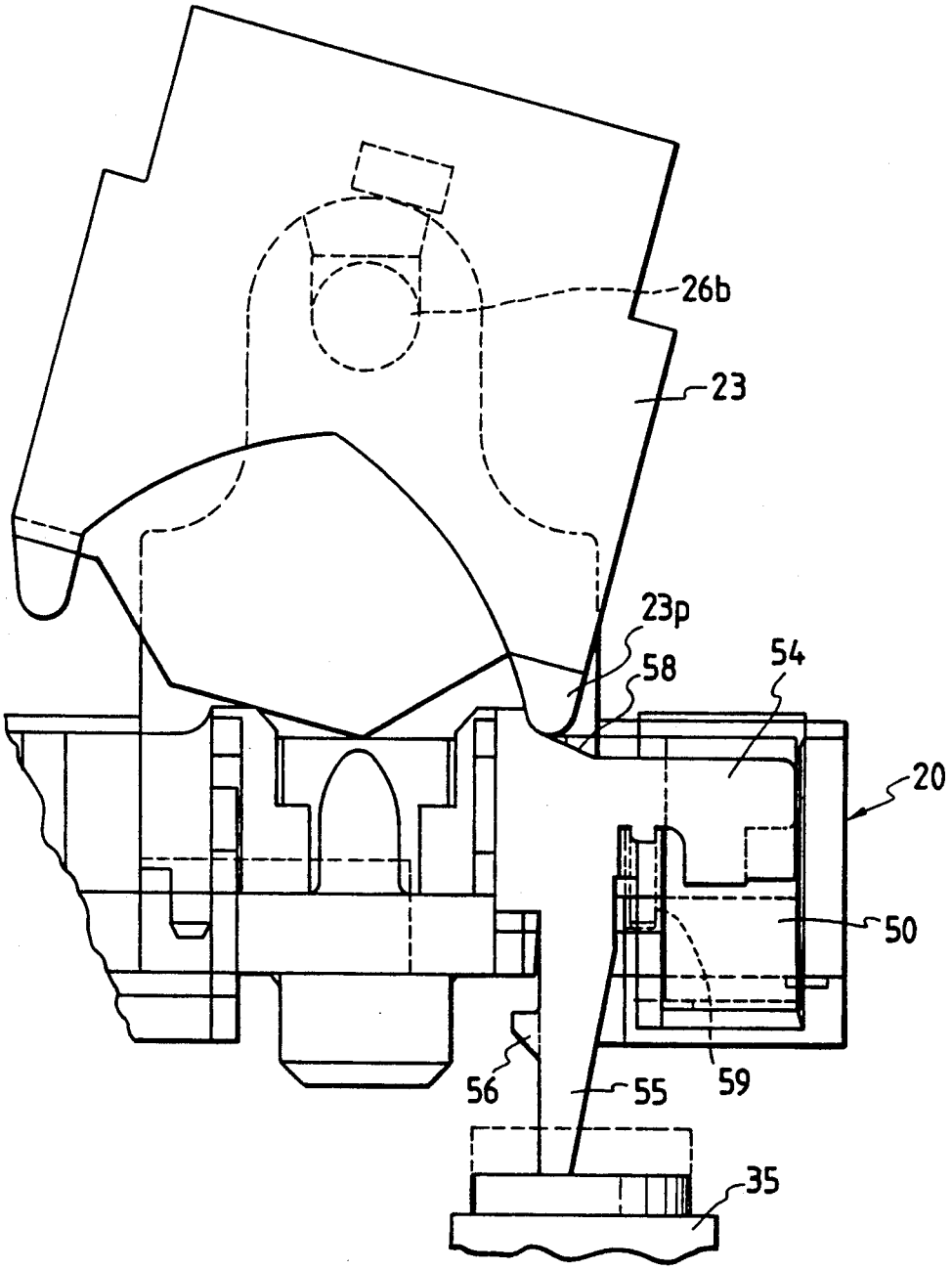

Then, the operation of the second embodiment will now be described with reference to FIGS. 12 and 14.

Figure 12:
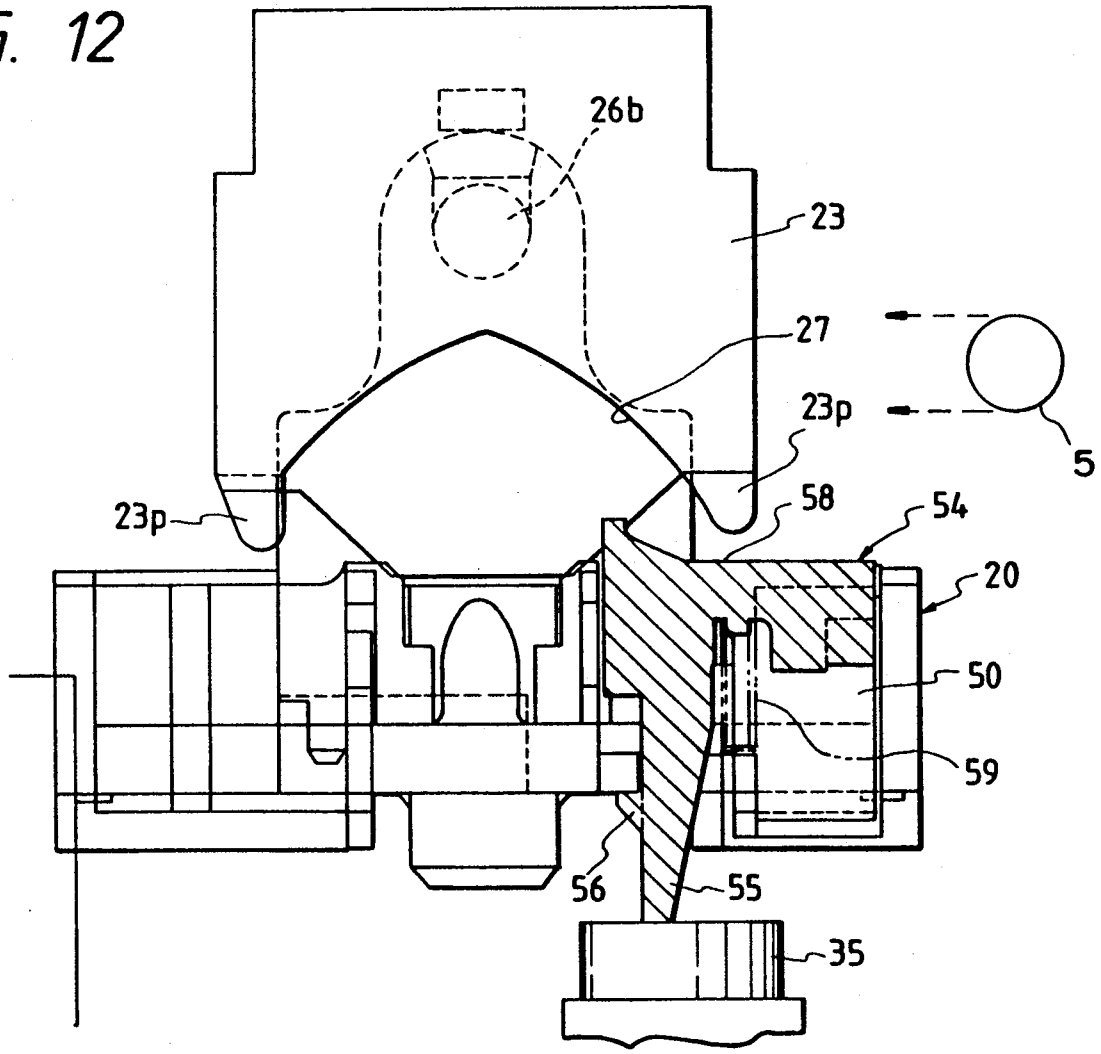
FIG. 12 illustrates a neutral position according to a second embodiment of the present invention.

FIG. 12 illustrates the neutral state of the switch device, wherein the movable contact 15 and the fixed contact 17 are not positioned in contact with each other similarly to the first embodiment. Also the movable contact 16 and the fixed contact 18 are not positioned in contact with each other. Therefore, the switch is switched off in this state. In the state shown in FIG. 12, the operating rod 54, which is being urged by the coil spring 59 in the direction opposing the inward pushing direction, is in a state in which its stopper projection 56 is positioned in contact with the lower surface of the wafer 56. The free ends of the leaf spring 50 are, as shown in FIG. 10, fastened and held by a claw member 60 formed in the upper portion on the inside of the accommodating hole 53. Illumination light emitted from the light source 5 illuminates and displays the operation display 25 from its reverse side.

Figure 13:
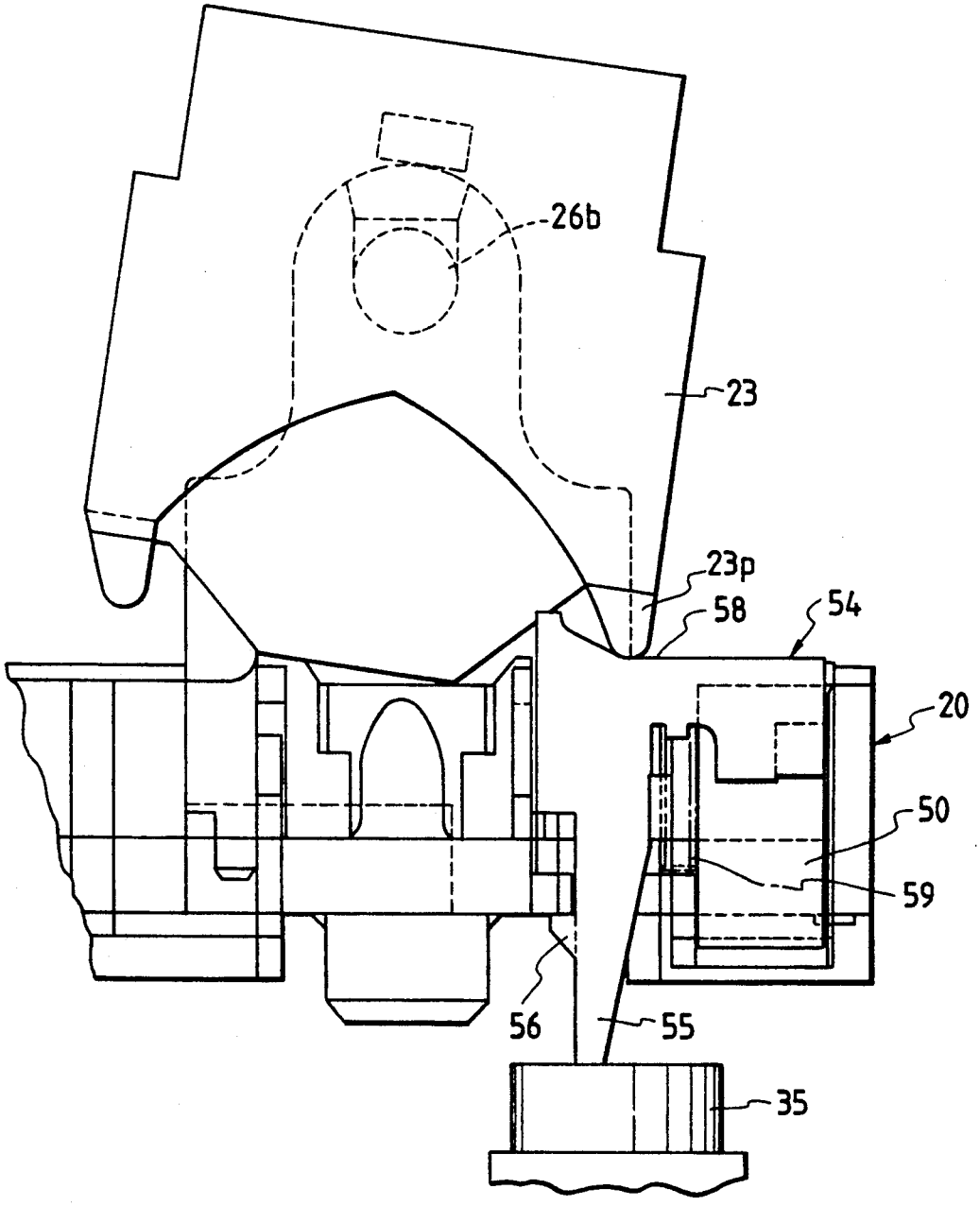

When the operation lever 23 is rotated clockwise in a state shown in FIG. 12, the movable contact 15, which is being rocked, comes in contact with the fixed contact 17 at a position at which the operation lever 23 is inclined as shown in FIG. 13. As a result, the switch is switched on and thereby the operation of opening the window is commenced. In this case, the opening operation is continued and the window is gradually opened so far as the operating lever 23 is held at the aforesaid position by the hand. Therefore, when the hand is removed from the operation lever 23 when the window has been opened by a desired degree, the state is returned to that shown in FIG. 12. As a result, the switch is switched off and the operation of opening the window is stopped. When the operation lever 23 is inclined, the pressing end portion 23*p* comes in contact with the slide surface 58 of the operating rod 54.

When the operation lever 23 is further rotated clockwise and is inclined in a state shown in FIG. 13, the contact operation is performed by the movable contact 15 and the fixed contact 17 while realizing the first clicking touch. Then, the operating rod 54 is further moved downwards by the pressing end portion 23*p* against the urging force of the coil spring 59. As a result, the operating portion 57 comes in contact with the clicking projections 52 of the leaf spring 50 and gets over the clicking projections 52 while expanding the bent members 51. At this time, the bent members 51 are reversed, causing the second clicking touch to be generated. As a result, the automatic switch 35 is switched on. When the automatic switch 35 is switched on, the window is opened until it is fully opened and is stopped in this state even if the hand is removed from the operation lever 23.

When the inward pushing of the operation lever 23 is stopped, the operation lever 23 is returned to the neutral position shown in FIG. 12 as described above. Also the inward pushing force acting on the operating rod 54 is removed. Therefore, the operating rod 54 is returned to the state shown in FIG. 12 by the urging force of the coil spring 59 and also the bent members 51 are returned to the state shown in FIG. 10 by their elastic force.

Similarly, the window is fully closed by the counterclockwise rotation of the operation lever 23.

According to the second embodiment thus constituted, the shape of the leaf spring 50 can be easily changed because the clip like leaf spring is used, the clicking touch can be freely set and the freedom can be improved as well as the effect obtainable from the aforesaid first embodiment.

In each of the embodiments, two automatic switches 35 may be provided for one switch device in order to perform the full-closing and opening operations, or only one automatic switch may be provided in order to perform the full-closing operation or the full-opening operation.

As described above, according to the present invention, a predetermined portion of the surface of the operating lever can be always clearly illuminated with light with a simple structure. As a result, the switching operation can be performed while preventing erroneous operations. Furthermore, a switch device in which the clicking touch can easily be set, which can be operated for a long time and which enables an advantage to be obtained in that the manufacturing cost can be reduced can be provided.

Although the invention has been described in its preferred form with a certain degree of particularly, it is understood that the present disclosure of the preferred form has been changed in the details of construction and the combination and arrangement of parts may be resorted to without departing from the spirit and the scope of the invention as hereinafter claimed.

What is claimed is:

1. A see-saw switch device comprising:

a base including a surface defining an opening;

a plurality of fixed contacts disposed on said base on a first side of said surface;

a pair of holding arms fixedly connected to said base on said first side of said surface;

a push button switch positioned adjacent said opening;

an operating member pivotably mounted to said holding arms and including a pressing portion;

a plurality of movable contacts pivotably positioned between said operating member and said base;

a leaf spring mounted to said base on said first side of said surface and over said opening; and an operation rod movably connected to said leaf spring and having a portion extending through said opening, said operating rod having a first end and a second end;

wherein when said operating member is pivoted into a first operating position, said pressing portion contacts said first end of said operation rod and said second end is disposed away from said push button switch, and said operating member contacts said movable contacts such that one of said movable contacts is pivoted to contact one of said plurality of fixed contacts; and wherein when said operating member is pivotable into a second operation position, said one of said movable contacts is held against said one of said plurality of fixed contacts, and said pressing portion presses against said first end, thereby inverting said leaf spring such that said second end actuates said push button switch.

2. A see-saw switch of claim 1 wherein said operating member is formed from a light conductive material and has a curved surface and a display surface, and said see-saw switch further comprises a light source located such that light from said light source is reflected by said curved surface and directed through said display surface.

* * * * *